US011246363B2

(12) United States Patent
Davis

(10) Patent No.: US 11,246,363 B2
(45) Date of Patent: Feb. 15, 2022

(54) HAIR EXTENSION WASHBOARD

(71) Applicant: Ashley Davis, Mableton, GA (US)

(72) Inventor: Ashley Davis, Mableton, GA (US)

( * ) Notice: Subject to any disclaimer, the term of this patent is extended or adjusted under 35 U.S.C. 154(b) by 0 days.

(21) Appl. No.: 16/520,332

(22) Filed: Jul. 23, 2019

(65) Prior Publication Data

US 2020/0022438 A1 Jan. 23, 2020

Related U.S. Application Data

(60) Provisional application No. 62/702,194, filed on Jul. 23, 2018.

(51) Int. Cl.

| | |
|---|---|
| ***B08B 3/04*** | (2006.01) |
| ***B08B 1/00*** | (2006.01) |
| ***A45D 19/04*** | (2006.01) |
| ***A45D 19/00*** | (2006.01) |
| ***A45D 20/00*** | (2006.01) |
| ***A41G 5/00*** | (2006.01) |

(52) U.S. Cl.

CPC ..... *A41G 5/004* (2013.01); *A45D 19/012* (2021.01); *A45D 19/04* (2013.01); *A45D 20/00* (2013.01); *B08B 1/00* (2013.01); *B08B 3/04* (2013.01)

(58) Field of Classification Search

CPC ..... B29F 9/001

See application file for complete search history.

(56) References Cited

U.S. PATENT DOCUMENTS

| | | | | |
|---|---|---|---|---|
| 5,058,403 | A * | 10/1991 | Barnes | D06F 3/02 68/229 |
| 2014/0312194 | A1* | 10/2014 | Segura | B42F 9/001 248/451 |
| 2014/0325863 | A1* | 11/2014 | Blum | A45D 20/00 34/101 |
| 2016/0309882 | A1* | 10/2016 | Abramyan | A41G 5/0086 |
| 2017/0143114 | A1* | 5/2017 | Bravo Rubies | A47B 23/042 |
| 2019/0090615 | A1* | 3/2019 | Ohlgart | F16B 2/10 |

OTHER PUBLICATIONS

Learn How to Color Human Hair Extensions Tutorial—Doctored Locks, Jul. 29, 2013. <https://www.youtube.com/watch?v=0LtP4bHrrRk>. (Year: 2013).*

* cited by examiner

*Primary Examiner* — Nicole Blan

(74) *Attorney, Agent, or Firm* — Charlena Thorpe, Esq.; Incorporating Innovation LLC

(57) ABSTRACT

Implementations of a hair extension washboard are provided. In some implementations, the hair extension washboard comprises a hair extensions board, a hair clip assembly, and a board support. In some implementations, the hair extension washboard further comprises a hair drying enclosure. In some implementations, the hair extension washboard also comprises surface connectors.

In some implementations, a method of using the hair extension washboard comprises positioning the hair extension washboard in a sink or other suitable location, holding hair extensions with the hair extension washboard, and washing, coloring, drying, etc. the hair extensions while held by the hair extension washboard.

7 Claims, 10 Drawing Sheets

HAIR EXTENSION WASHBOARD

CROSS REFERENCE TO RELATED APPLICATION

This application claims the benefit of U.S. Patent Application Ser. No. 62/702,194, which was filed on Jul. 23, 2018, and is incorporated herein by reference in its entirety.

TECHNICAL FIELD

This disclosure relates to implementations of a hair extension washboard.

BACKGROUND

FIGS. 1A-1C illustrate example hair extensions, which are sometimes referred to as hair wefts. As shown in FIG. 1C, hair extensions are a plurality of strings of hair sewn together on one end to form an elongated strip or weft of hair. The elongated weft of hair extends horizontally in a first direction and the strings of hair hang vertically in a second direction that is perpendicular to the first direction. The hair extensions are attached to a wearer's head at the weft of the hair extensions.

However, as shown in FIG. 1B, hair extensions are difficult to wash, color, and/or dry when the hair extensions are not attached to a wearer's head or are otherwise secured. Furthermore, even when the hair extensions are attached to a wearer's head or are otherwise secured by existing tools or methods, the weft of the hair extensions remains inaccessible to wash, color, and/or dry. There are no existing tools or methods for washing, coloring, and/or drying hair extensions including the wefts without difficulty whether the hair extensions are attached to a wearer's head or are otherwise secured.

DETAILED DESCRIPTION

Implementations of a hair extension washboard are provided. In some implementations, the hair extension washboard comprises a hair extensions board, a hair clip assembly, and a board support. In some implementations, the hair extension washboard further comprises a hair drying enclosure. In some implementations, the hair extension washboard also comprises surface connectors.

In some implementations, the hair extension washboard is configured to hold one or more hair extensions for washing, coloring, drying, etc. the hair extensions on the hair extension washboard. In some implementations, the hair extension washboard is configured to hold one or more hair extensions in place while permitting all or a substantial portion of the hair weft to be accessible for washing, coloring, drying, etc. In some implementations, the hair extension washboard is further configured to connect to a hair dryer to dry hair extensions held on the hair extension washboard.

In this way, in some implementations, the hair extension washboard allows hair extensions, including the weft, that are not attached to a wearer's head or otherwise secured to be held and accessible to wash, color, dry, etc. the hair extensions. Furthermore, in this way, in some implementations, the hair extension washboard allows hair extensions, including the weft, to be dried on the hair extension washboard using heated air from a hair dryer or other source of heated air.

In some implementations, a method of using the hair extension washboard comprises positioning the hair extension washboard in a sink or other suitable location, holding hair extensions with the hair extension washboard, and washing, coloring, drying, etc. the hair extensions while held by the hair extension washboard.

Figure 1A:
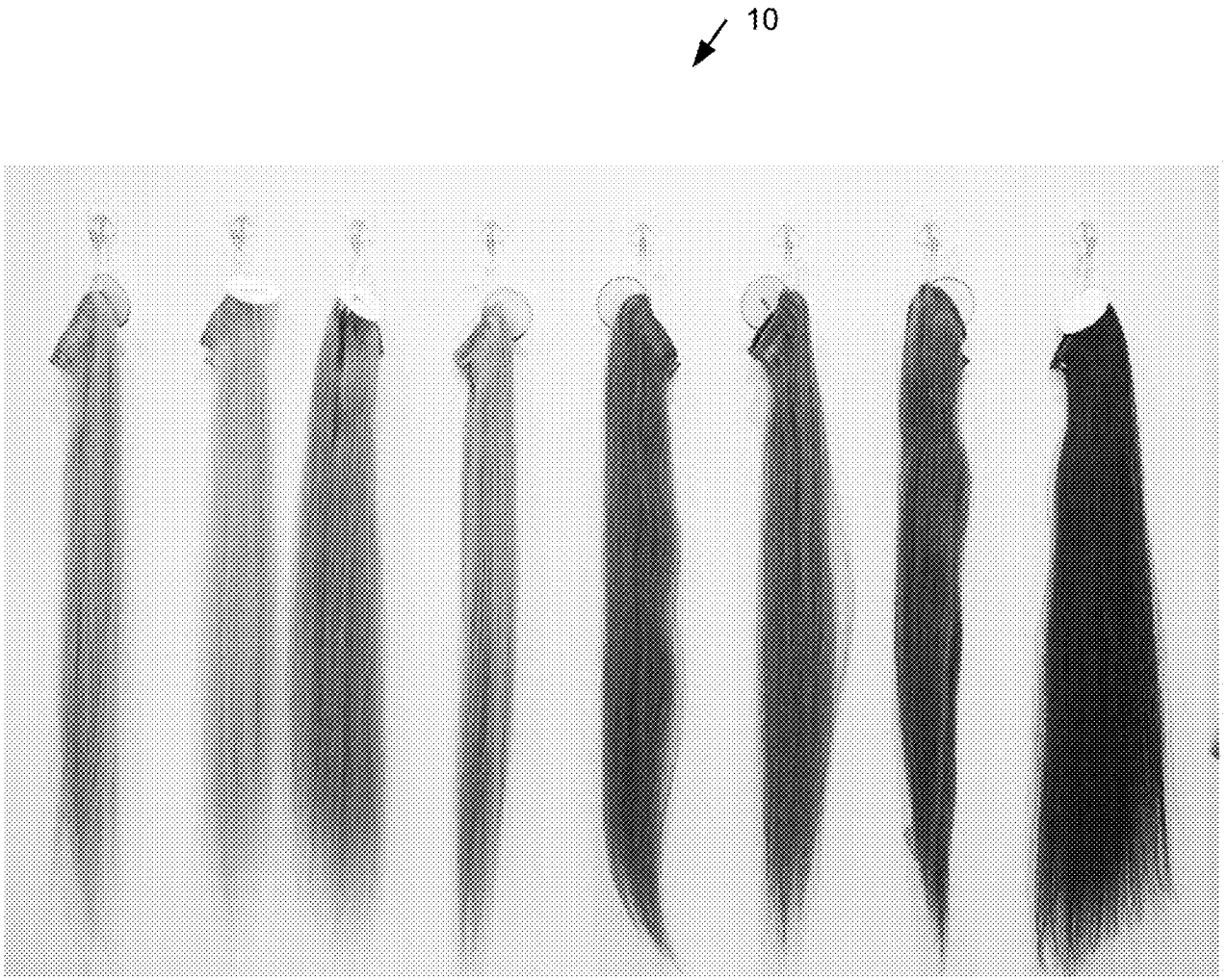
FIGS. 1A and 1C illustrate example hair extensions that can be washed, colored, or dried using implementations of the hair extension washboard of the present disclosure.
Figure 1B:
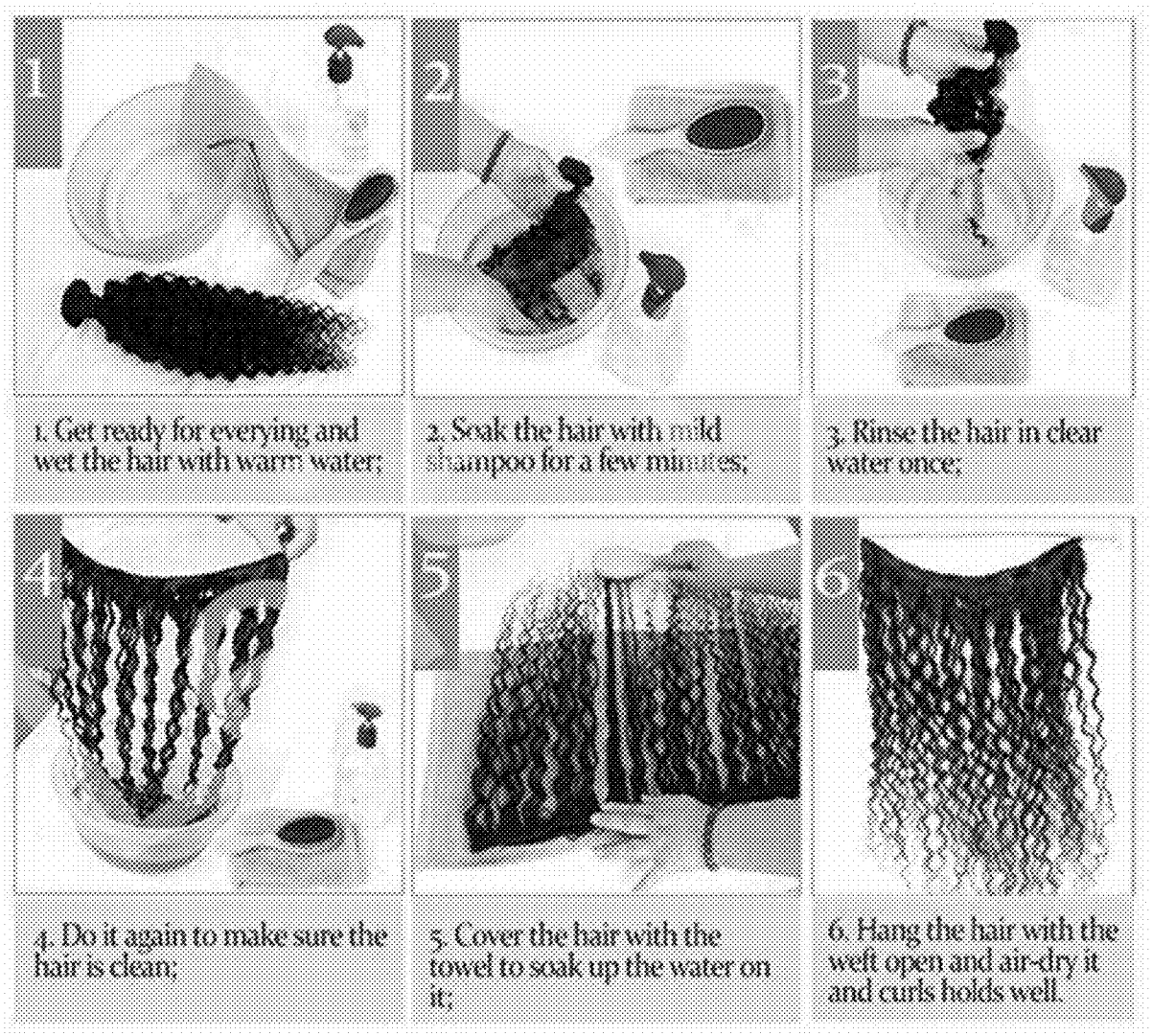
FIG. 1B illustrates an existing method to wash and dry hair extensions when the hair extensions are not attached to a wearer's head or are otherwise secured.
Figure 1C:
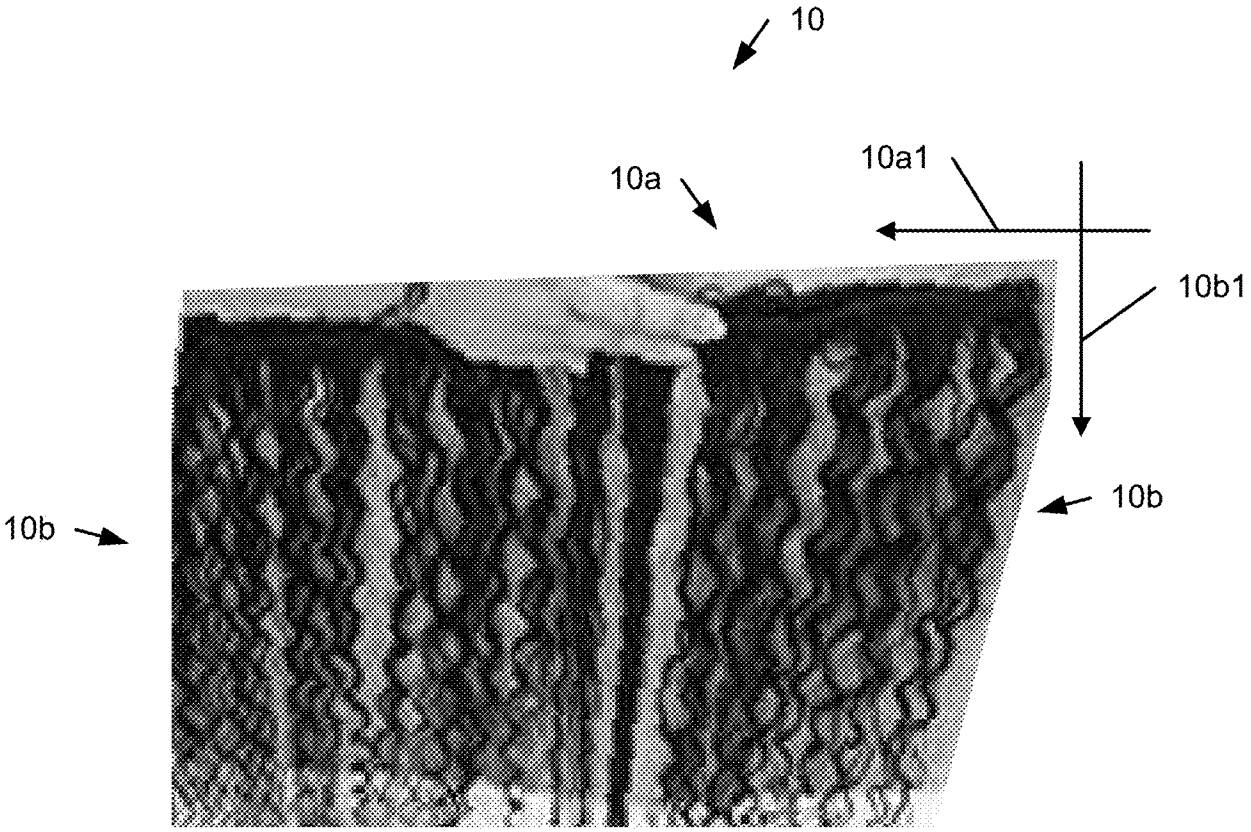

FIGS. 1A and 1C illustrate example hair extensions 10 that can be washed, colored, or dried using implementations of the hair extension washboard of the present disclosure. The hair extensions 10 are a plurality of strings 10*b* of hair sewn together on one end 10*a* to form an elongated strip or weft of hair. The elongated weft 10*a* extends horizontally in a first direction 10*a*1 and the strings 10*b* of hair hang vertically in a second direction 10*b*1. In some implementations, the second direction is substantially perpendicular to the first direction 10*a*1. The hair extensions 10 are attached to a wearer's head at the weft 10*a* of the hair extensions 10.

As shown in FIG. 1B, the hair extensions 10 are difficult to wash, color, and/or dry when the hair extensions 10 are not attached to a wearer's head or are otherwise secured. Furthermore, even when the hair extensions 10 are attached to a wearer's head or are otherwise secured, the weft 10*a* of the hair extensions 10 remains inaccessible to wash, color, and/or dry.

Figure 2A:
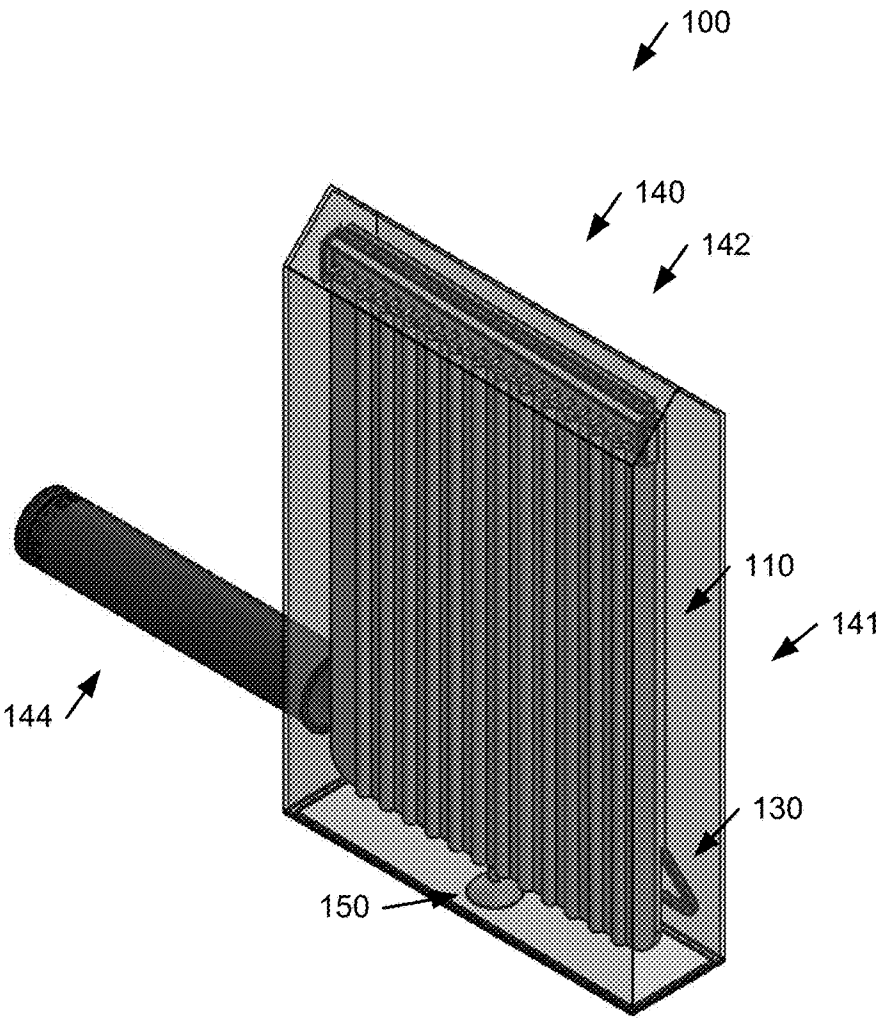
FIGS. 2A-2B illustrate an assembled and an exploded perspective view respectively of an implementation of an example hair extension washboard according to the present disclosure.
Figure 2B:
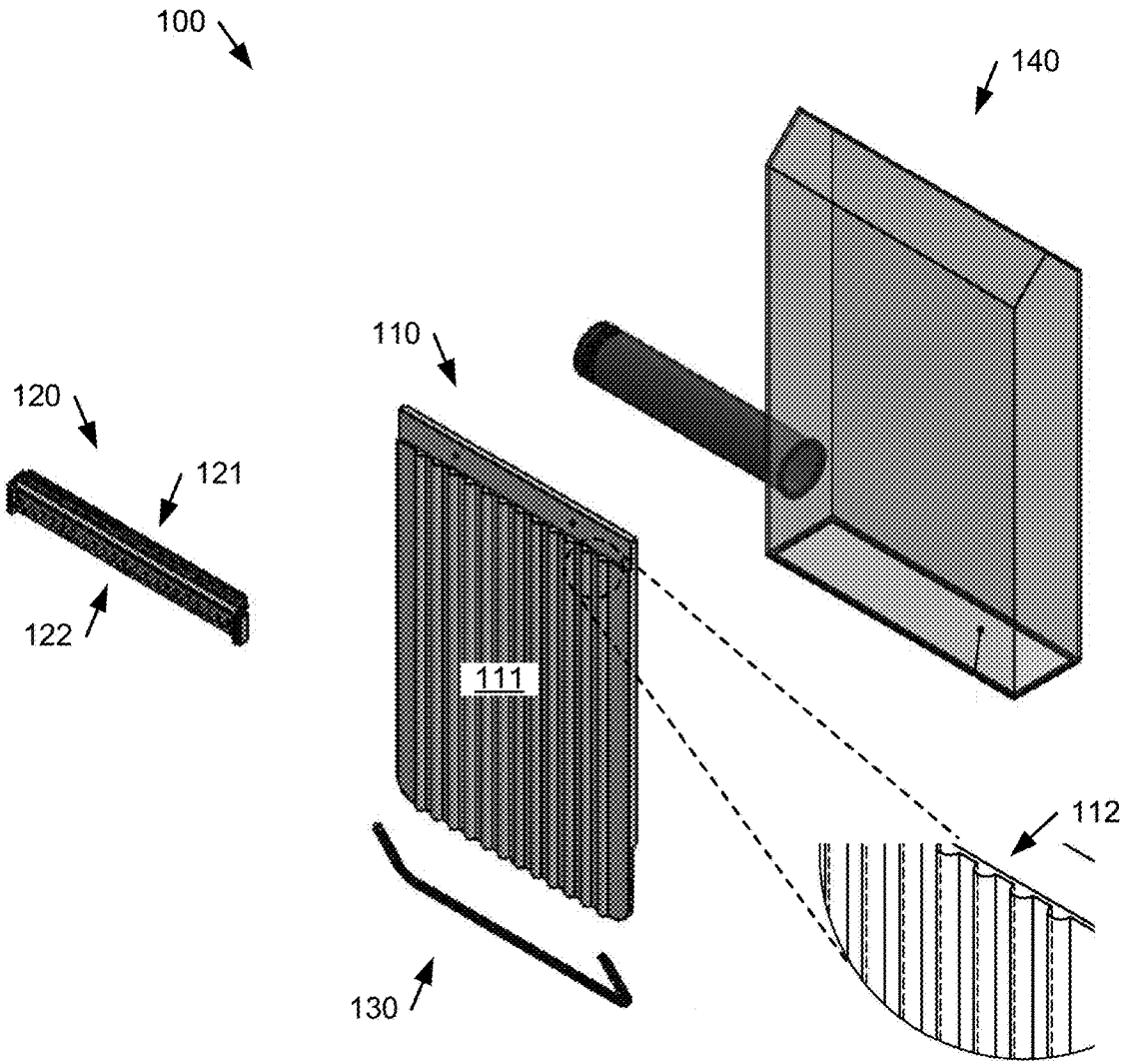

As described above, FIGS. 2A-2I illustrate various views of an implementation of an example hair extension washboard 100 according to the present disclosure. As shown in FIG. 2B, in some implementations, the hair extension washboard 100 comprises a board 110, a hair securing assembly or hair clip assembly 120, and a stand or support 130. In some implementations, the hair extension washboard 100 further comprises a dryer tent or hair drying enclosure 140. As shown in FIGS. 2C and 2G, in some implementations, the hair extension washboard 100 may also comprise one or more connectors 150, such as suction cups.

As shown in FIG. 2B, in some implementations, the board 110 of the hair extension washboard 100 comprises a rectangular panel shape. In some implementations, the board 110 may comprise any other suitable shape.

As shown in FIG. 2B, in some implementations, the board 110 comprises at least one surface 111 that is configured to support hair extensions 10 (e.g., for hair styling) upon the surface 111.

As shown in FIG. 2B, in some implementations, the board 110 and/or the surface 111 comprises ridges or ripples 112. For example, in some implementations, the board 110 and/or surface 111 may comprise a ridged or rippled shape 112. In some implementations, the board 110 and/or the surface 111 may comprise any other suitable shape that helps to wash or otherwise treat hair extensions 10, such as described herein.

In some implementations, the ripples 112 may be configured to help wash hair extensions 10 using the hair extension washboard 100, such as by rubbing the hair extensions 10 across the ripples 112. In some implementations, the ripples 112 may be configured to help to gently clean hair extensions 10, e.g. without causing damage to the hair extensions 10. In some implementations, the ripples 112 may be configured to provide any other suitable feature with respect to using the hair extension washboard 100 to wash or otherwise treat hair extensions 10, such as described herein.

As shown in FIG. 2C, in some implementations, the board 110 may also have one or more connectors 150, such as suction cups, connected (or attached) to the board 110, such as at or adjacent to the bottom side of the board 110. In some implementations, the connectors 150 are connected to the board 150 to help position and/or steady the hair extension washboard 100 for use, as described further below.

As shown in FIG. 2G, in some implementations, the hair clip assembly 120 comprises a clip mechanism 121 and a securing station or clip bar 122.

As shown in FIG. 2G, in some implementations, the clip mechanism 121 and the clip bar 122 connect (or attach) together such that the hair clip assembly 120 can clip or clamp hair extensions 10 to hold the hair extensions 10 in position on the hair extension washboard 100, such as on the surface 111 of the board 110. For example, in some implementations, the clip mechanism 121 is configured to clip hair extensions 10 against the clip bar 122 to hold the hair extensions 10 in position on the hair extension washboard 100.

In some implementations, the clip mechanism 121 comprises any suitable components such that the clip mechanism 121 can clip hair extensions 10 against the clip bar 122.

As shown in FIG. 2G, in some implementations, the clip bar 122 comprises an elongated bar having a plurality of pegs or similar elements 123 extending from it. In some implementations, the pegs 123 are configured to help the hair clip assembly 120 to clip and hold hair extensions 10.

As shown in FIG. 2C, in some implementations, the hair clip assembly 120 positions on the surface 111 of the board 110. In some implementations, the hair clip assembly 120 positions at or adjacent to the top end of the board 110. In some implementations, the hair clip assembly 120 extends at least partially across the width of the board 110. In some implementations, the hair clip assembly 120 positions in any other suitable manner with respect to the board 110.

In some implementations, the hair clip assembly 120 removably connects to the board 110. Furthermore, as shown in FIG. 2G, in some implementations, the hair clip assembly 120 can have connectors 150, such as suction cups, removably connected to the hair clip assembly 120 while the hair clip assembly 120 is disconnected from the board 110. In some implementations, the hair clip assembly 120 can be removably connected to the connectors 150 such that the hair clip assembly 120 can be removably positioned by the connectors 150 adjacent to other surfaces, such as a shower or bathtub wall. In this way, in some implementations, the hair clip assembly 120 can be alternately used to clamp and hold hair extensions 10 while positioned adjacent to such other surfaces to wash, color, dry, etc. the hair extensions 10.

Figure 2D:
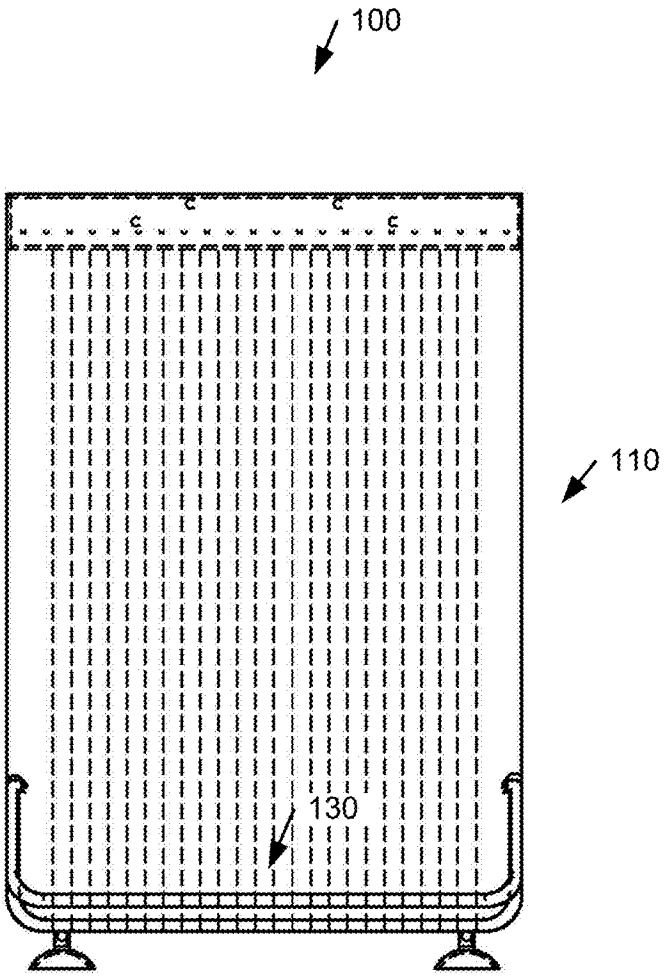
FIGS. 2C-2D illustrate a front and a back view respectively of the example hair extension washboard according to the present disclosure.
Figure 2C:
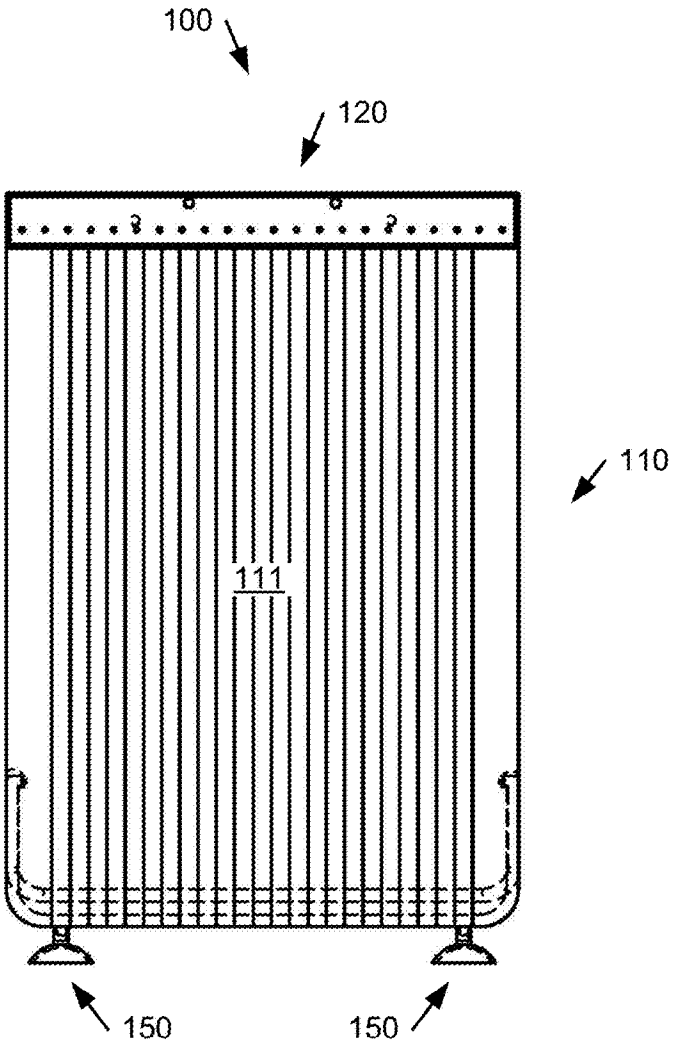
Figure 2F:
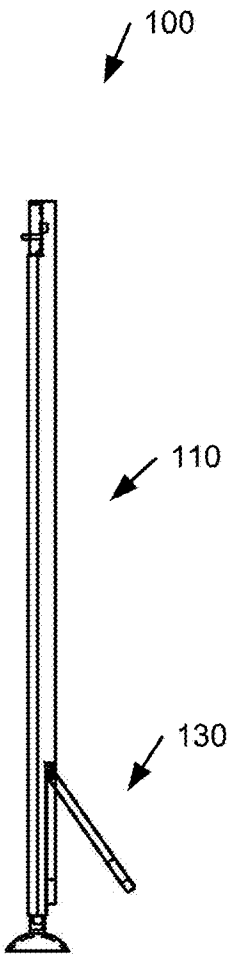
FIGS. 2E-2F illustrate a side view of the example hair extension washboard according to the present disclosure.
Figure 2E:
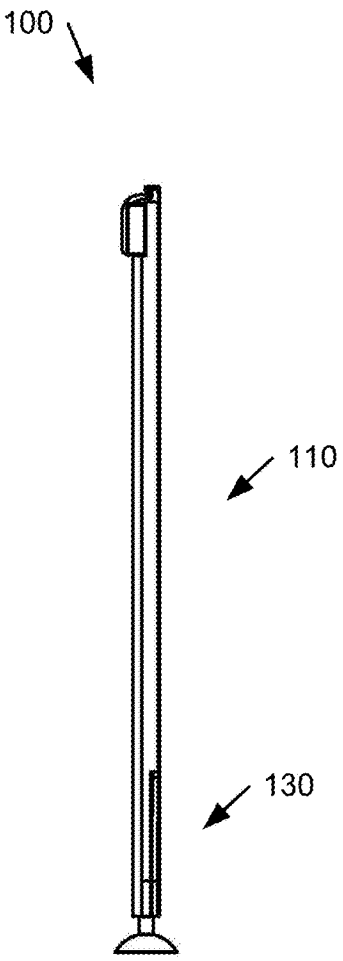
Figure 2G:
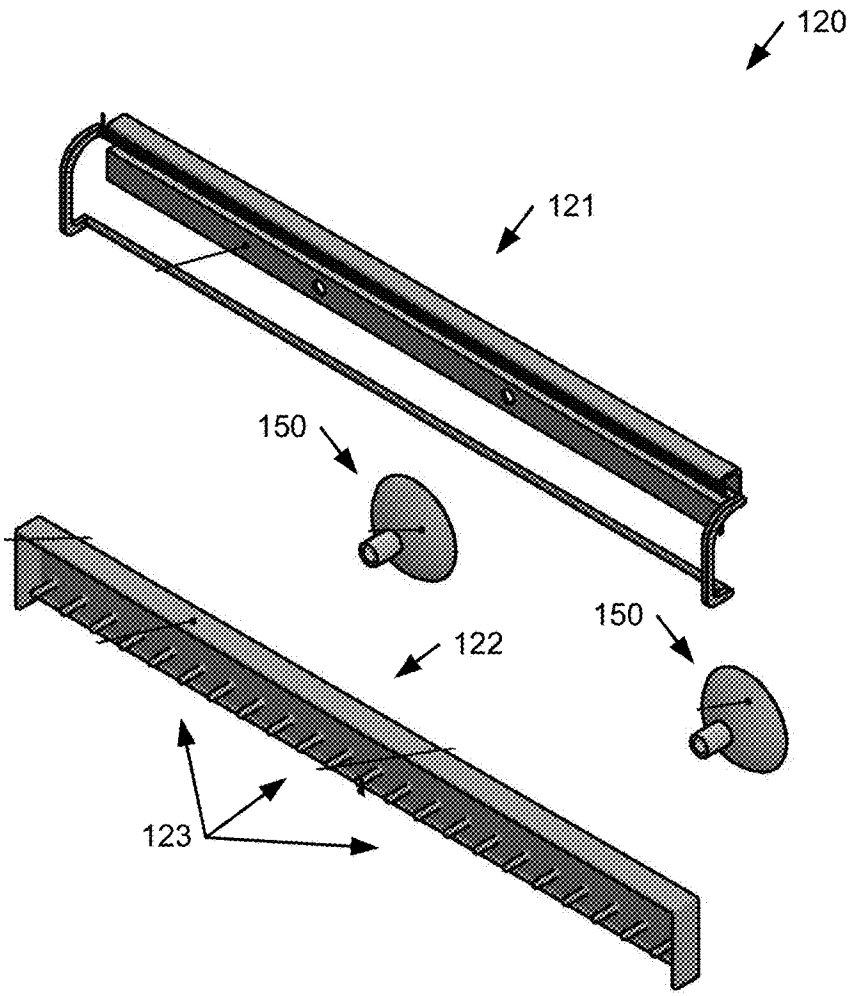
FIG. 2G illustrates an exploded view of an example hair clip assembly of the hair extension washboard according to the present disclosure.
Figure 2H:
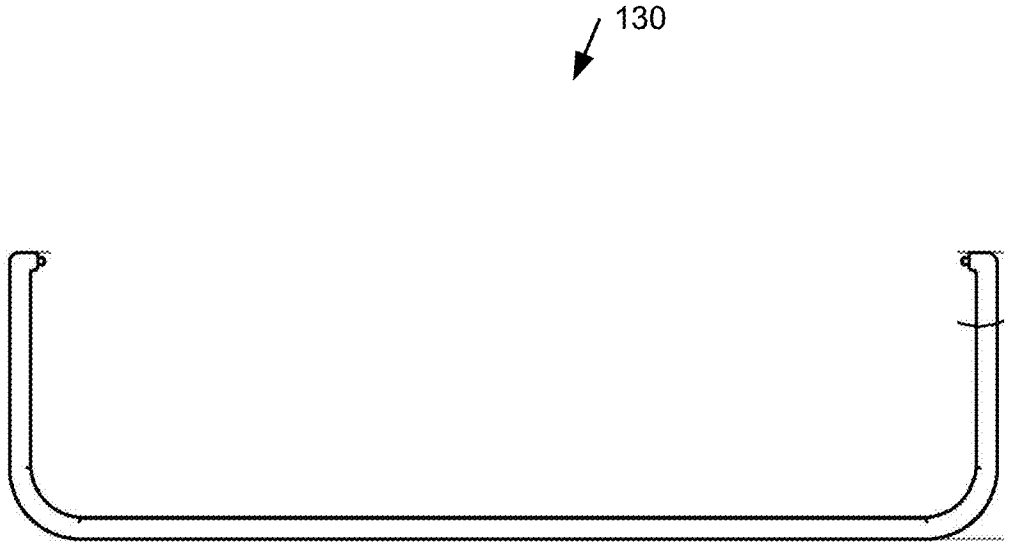
FIG. 2H illustrates an example support of the hair extension washboard according to the present disclosure.
Figure 2I:
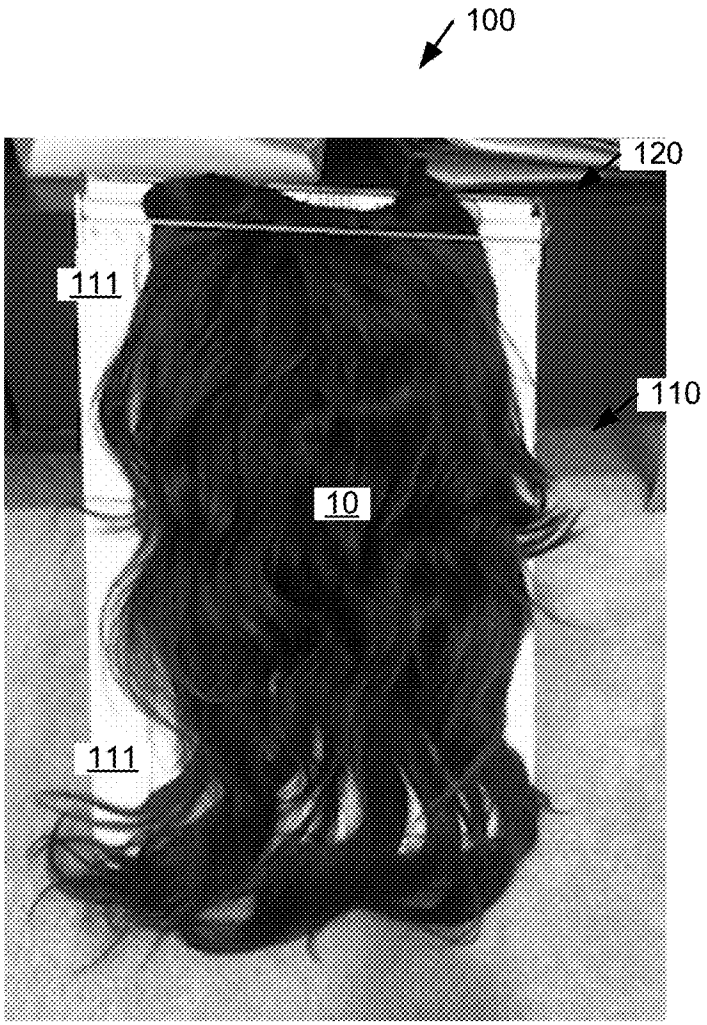
FIG. 2I illustrates an example use of the hair extension washboard according to the present disclosure.

As shown in FIG. 2I, in some implementations, the hair clip assembly 120 is configured to hold hair extensions 10 on the hair extension washboard 100, such as on the surface 111 of the board 110. In some implementations, the hair clip assembly 120 is configured to securely hold hair extensions 10 without damaging the hair extensions 120.

In some implementations, the hair clip assembly 120 is configured to hold hair extensions 10 while permitting all or a substantial portion of the hair weft to be accessible for washing, coloring, drying, etc.

As shown in FIG. 2H, in some implementations, the support 130 comprises an elongated U-shaped bracket or similar component. In some implementations, the support 130 may comprise any other suitable shape. In some implementations, the support 130 may comprise any other suitable configuration, such as one or more elongated leg components.

As shown in FIGS. 2D and 2F, in some implementations, the support 130 connects to the board 110, such as at or adjacent to the bottom portion of the board 110. In some implementations, the support 130 connects to the board 110 such that the support 130 can help to steady or support the hair extension washboard 100 in an upright or substantially upright position, e.g. partially inclined or leaning.

As shown in FIGS. 2E and 2F respectively, in some implementations, the support 130 connects to the board 110 such the support can be positioned in a stowed position adjacent to the board 110 or an extended position extending from the board 110 to support the hair extension washboard 100.

In some implementations, the support 130 is configured to position in a stowed position adjacent to the board 110 or an extended position extending from the board 110.

In some implementations, the support 130 is configured to support (e.g., prop) the hair extension washboard 100 in an upright or substantially upright position, e.g. partially inclined or leaning, such as when the support 130 is an extended position extending from the board 110. In some implementations, the support 130 may be configured to support the hair extension washboard 100 in an upright or substantially upright position along with the connectors 150 connected to the bottom side of the board 110.

As shown in FIG. 2A, in some implementations, the hair drying enclosure 140 comprises a body portion 141, a top portion 142, and a dryer hose or input tube 144. In some implementations, the top portion 142 is configured to open and close the hair drying enclosure 140 to enclose the board 110 and connected components (collectively the "hair extension washboard 100") within the hair drying enclosure 140.

In some implementations, the input tube 144 is connected to the body 141 of the hair drying enclosure 140. In some implementations, the input tube 144 is configured to allow heated air to be input into the hair drying enclosure 140. For example, in some implementations, the input tube 144 is configured to connect to a hair dryer (not shown) to allow the hair dryer to blow hot air into the hair drying enclosure 140. In some implementations, the heated air can be inputted into the hair drying enclosure 100 to dry hair extensions 10 held by the hair extension washboard 100.

As shown in FIG. 2A, in some implementations, the hair drying enclosure 140 comprises a semi-rectangular shaped pouch or enclosure. In some implementations, the hair drying enclosure 140 is shaped to enclose the hair extension washboard 100, such as the board 110 and other components connected to the board 110. In some implementations, the hair drying enclosure 140 may comprise any other suitable shape.

In some implementations, the hair drying enclosure 140 is porous (e.g., air permeable) and/or comprises openings (not shown) to allow heated air inputted into the hair drying enclosure 140 to be efficiently released from the hair drying enclosure 140. For example, in some implementations, the hair drying enclosure 140 is sufficiently porous to allow inputted heated air to efficiently dry hair extensions 10 held by the hair extension washboard 100 within the hair drying enclosure 140 without stretching or otherwise damaging the hair drying enclosure 140. That is, in some implementations, the hair drying enclosure is sufficiently porous efficiently vent inputted air from the hair drying enclosure 140.

In some implementations, the hair drying enclosure 140 is configured to enclose the hair extension washboard 100. In some implementations, the hair drying enclosure 140 is configured to enclose the hair extension washboard 100 positioned in an upright or substantially upright position, such as supported by the support 130 and/or the connectors 150.

In some implementations, the hair drying enclosure 140 is configured to receive heated air into the hair drying enclosure 140 through the input tube 144. In some implementations, the hair drying enclosure 140 is configured to receive heated air from a hair dryer or other suitable heated air source connected to the input tube 144.

In some implementations, the hair drying enclosure 140 is configured to receive heated air to dry hair extensions 10 held by the hair extension washboard 100 enclosed within the hair drying enclosure 140. In some implementations, the hair drying enclosure 140 is configured to appropriately vent heated air inputted into the hair drying enclosure 140.

In some implementations, the hair drying enclosure 140 may be configured to provide any other suitable features for the hair extension washboard 100.

As shown in FIGS. 2C and 2G, in some implementations, the connectors 150 comprise suction cups. In some implementations, the connectors 150 may comprise any other suitable connector.

In some implementations, the connectors 150 are configured to removably connect to components of the hair extension washboard 100, such as the board 110 and the hair clip assembly 120. In some implementations, the connectors 150 are configured to removably connect to a surface, such as shower or bathroom wall, to thereby connect or support the hair extension washboard 100 in a position.

In some implementations, the hair extension washboard 100 is configured to hold one or more hair extensions, such as the hair extensions 10 described above for FIGS. 1A-1C, in place while permitting all or a substantial portion of the hair weft to be accessible for washing, coloring, drying, etc.

In some implementations, the hair extension washboard 100 is configured to hold one or more hair extensions 10 for washing the hair extensions 10 on the hair extension washboard 100. In some implementations, the hair extension washboard 100 is configured to hold hair extensions 10 for coloring the hair extensions 10 on the hair extension washboard 100. In some implementations, the hair extension washboard 100 is configured to hold hair extensions 10 for drying the hair extensions 10 on the hair extension washboard 100, for example after washing and/or coloring the hair extensions 10.

In some implementations, the hair extension washboard 100 is configured to be positioned in a sink for usage. In some implementations, the hair extension washboard 100 is configured to be positioned across a sink opening for usage. In some implementations, the hair extension washboard 100 is configured to be positioned on a table for usage. In some implementations, the hair extension washboard 100 is configured to be positioned in any other suitable location for usage.

In some implementations, the hair extension washboard 100 comprises any suitable dimensions.

In some implementations, the hair extension washboard 100 is composed of any suitable material. For example, in some implementations, some components or portions thereof, such as the board 110, may be composed of a plastic material. In some implementations, some components or portions thereof, such as the hair clip assembly 120, may be composed of a metal material. In some implementations, some components or portions thereof, such as the hair drying enclosure 140, may be composed of a thermal coated polyester material.

In some implementations, the hair extension washboard 100 can have any suitable appearance.

In some implementations, an example method of using the hair extension washboard 100, with respect to the above descriptions for FIGS. 2A-2I, comprises positioning the hair extension washboard 100 in a sink, on a table, or in any other suitable location for use. In some implementations, the hair extension washboard 100 is positioned in an upright or substantially upright position, such as partially inclined or leaning, using the support 130 and/or the connectors 150. In some implementations, the hair extension washboard 100 is positioned in any other suitable way.

As shown in FIG. 2I, in some implementations, the method comprises holding one or more hair extensions 10 on the board 110 with the hair clip assembly 120.

In some implementations, the method comprises washing, coloring, etc. the hair extensions 10 held on the board 110.

In some implementations, the method further comprises drying the hair extensions 10 held on the board 110 (e.g., after washing or coloring). In some implementations, the board 110 and components connected thereto (the "hair extension washboard 100") is positioned (e.g., upright or substantially upright) and enclosed in the hair drying enclosure 140 to dry the hair extensions 10. In some implementations, a hair dryer is connected and used to input heated air to the hair drying enclosure 140 through the input tube 144 to thereby dry the hair extensions 10 held on the hair extension washboard 100.

In some implementations, another method of using the hair extension washboard 100 comprises disconnecting the hair clip assembly 120 from the board 110, connecting one or more connectors 150 (such as suction cups) to the hair clip assembly 120, and connecting the hair clip assembly 120 to a surface such as shower or bathtub wall by the connectors 150.

In some implementations, the method comprises holding one or more hair extensions 10 with the hair clip assembly 120. In some implementations, the method comprises washing, coloring, drying, etc. the hair extensions 10 while held by the hair clip assembly 120.

The figures, including photographs and drawings, comprised herewith may represent one or more implementations of the hair extension washboard.

Details shown in the figures, such as dimensions, descriptions, etc., are exemplary, and there may be implementations of other suitable details according to the present disclosure.

Reference throughout this specification to "an embodiment" or "implementation" or words of similar import means that a particular described feature, structure, or characteristic is comprised in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations may be depicted in the drawings in a particular order, this should not be understood as requiring that such operations be performed in the particular order shown or in sequential order, or that all illustrated operations be performed, to achieve desirable results.

The invention claimed is:

1. A hair extension washboard, comprising:

a hair extensions board made from plastic having a rectangular panel shape and configured to support hair extensions positioned thereon to wash, color, or dry the hair extensions thereon;

a hair clip assembly attached widthwise along a surface adjacent to a top side of the hair extensions board, comprising a hair clip mechanism comprising an elongated bar configured to removably clamp the hair extensions to the board by movement of the elongated bar, and configured to hold the hair extensions positioned on the surface of the hair extensions board wherein the hair clip mechanism is configured to expose a substantial portion of the hair weft of the hair extensions for washing, coloring, or drying the hair weft wherein the outside top surface of the hair clip assembly has an opening therethrough to expose the hair weft;

a board support attached to the hair extensions board on each side across the width of the hair extensions board adjacent to a bottom side of the hair extensions board opposite the top side, comprising an elongated U-shaped bracket, and configured to support the hair extensions board in an upright or partially inclined position upon a sink or table surface; and a suction cup connector attached to the bottom side of the hair extensions board such that the suction cup connector suction attaches to the sink or table surface with the hair extensions board positioned upright or partially inclined upon the sink or table surface, and a hair drying enclosure shaped to enclose the hair extension washboard with the hair extensions board positioned upright or partially inclined and the hair clip assembly holding the hair extensions positioned on the hair extensions board, comprising a thermal insulated air permeable pouch, and configured to connect to a hair dryer through an input opening of the hair drying enclosure to allow heated air into the hair drying enclosure that dries the hair extensions held on the hair extensions board within the hair drying enclosure.

2. The hair extension washboard of claim 1, wherein the surface of the hair extensions board that supports the hair extensions comprises a rippled shape that allows the hair extensions to be rubbed across the surface to wash the hair extensions.

3. The hair extension washboard of claim 1, wherein the hair clip assembly is further configured to be removed from the hair extensions board and attached to a shower or bathtub wall by another suction cup connector while the hair clip assembly holds the hair extensions to allow the hair extensions to be washed, colored, or dried adjacent to the shower or bathtub wall.

4. The hair extension washboard of claim 1, wherein the board support is positionable in a stowed position adjacent to the hair extensions board and in an extended position extending from the hair extensions board to support the hair extensions board in the upright or partially inclined position.

5. A method of using a hair extension washboard, the method comprising:

positioning the hair extension washboard upon a sink or table surface wherein the hair extension washboard comprises a hair extensions board made from plastic having a rectangular panel shape and configured to support hair extensions positioned thereon to wash, color, or dry the hair extensions thereon; a hair clip assembly attached widthwise along a surface adjacent to a top side of the hair extensions board, comprising a hair clip mechanism comprising an elongated bar configured to removably clamp the hair extensions to the board by movement of the elongated bar, and configured to hold the hair extensions positioned on the surface of the hair extensions board wherein the hair clip mechanism is configured to expose a substantial portion of the hair weft of the hair extensions for washing, coloring, or drying the hair weft wherein the outside top surface of the hair clip assembly has an opening therethrough to expose the hair weft; a board support attached to the hair extensions board on each side across the width of the hair extensions board adjacent to a bottom side of the hair extensions board opposite the top side, comprising an elongated U-shaped bracket, and configured to support the hair extensions board in an upright or partially inclined position upon a sink or table surface; and a suction cup connector attached to the bottom side of the hair extensions board such that the suction cup connector suction attaches to the sink or table surface with the hair extensions board positioned upright or partially inclined upon the sink or table surface wherein the hair extensions board is positioned in the upright or partially inclined position by the board support and the suction cup connector;

holding the hair extensions positioned on the surface of the hair extensions board by the elongated bar of the hair clip assembly; and washing or coloring the hair extensions including the hair weft through the opening of the hair clip assembly while held on the surface of the hair extensions board.

6. The method of claim 5, further comprising:

enclosing the hair extension washboard within a hair drying enclosure positioned in the upright or partially inclined position wherein the hair extension washboard further comprises the hair drying enclosure shaped to enclose the hair extension washboard with the hair extensions board positioned upright or partially inclined and the hair clip assembly holding the hair extensions positioned on the hair extensions board, wherein the hair drying enclosure comprises a thermal insulated air permeable pouch, and is configured to connect to a hair dryer through an input opening of the hair drying enclosure to allow heated air into the hair drying enclosure that dries the hair extensions held on the hair extensions board within the hair drying enclosure;

connecting the hair dryer to the input opening of the hair drying enclosure; and inputting heated air from the hair dryer into the hair drying enclosure through the input opening to dry the hair extensions held on the hair extensions board within the hair drying enclosure.

7. A method of using a hair extension washboard of claim 3, the method comprising:

removing a hair clip assembly from a hair extensions board wherein the hair extension washboard comprises the hair extensions board made from plastic having a rectangular panel shape and configured to support hair extensions positioned thereon to wash, color, or dry the hair extensions thereon; the hair clip assembly attached widthwise along a surface adjacent to a top side of the hair extensions board, comprising a hair clip mechanism comprising an elongated bar configured to removably clamp the hair extensions to the board by movement of the elongated bar, and configured to hold the hair extensions positioned on the surface of the hair extensions board wherein the hair clip mechanism is configured to expose a substantial portion of the hair weft of the hair extensions for washing, coloring, or drying the hair weft wherein the outside top surface of the hair clip assembly has an opening therethrough to expose the hair weft; a board support attached to the hair extensions board on each side across the width of the hair extensions board adjacent to a bottom side of the hair extensions board opposite the top side, comprising an elongated U-shaped bracket, and configured to support the hair extensions board in an upright or partially inclined position upon a sink or table surface; and a suction cup connector attached to the bottom side of the hair extensions board such that the suction cup connector suction attaches to the sink or table surface with the hair extensions board positioned upright or partially inclined upon the sink or table surface wherein the hair extensions board is positioned in the upright or partially inclined position, wherein the hair clip assembly is further configured to be removed from the hair extensions board and attached to a shower or bathtub wall by another suction cup connector while the hair clip assembly holds the hair extensions to allow the hair extensions to be washed, colored, or dried adjacent to the shower or bathtub wall;

attaching the hair clip assembly to the shower or bathtub wall by the other suction cup connector;

holding the hair extensions with the hair clip assembly; and washing the hair extensions.

* * * * *